US010508819B2

(12) United States Patent
Kelly et al.

(10) Patent No.: US 10,508,819 B2
(45) Date of Patent: Dec. 17, 2019

(54) AIR TREATMENT SYSTEM

(71) Applicant: KONINKLIJKE PHILIPS N.V., Eindhoven (NL)

(72) Inventors: Declan Patrick Kelly, Eindhoven (NL); Michael Martin Scheja, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 15/765,512

(22) PCT Filed: Oct. 15, 2016

(86) PCT No.: PCT/EP2016/074822

§ 371 (c)(1),
(2) Date: Apr. 3, 2018

(87) PCT Pub. No.: WO2017/064314

PCT Pub. Date: Apr. 20, 2017

(65) Prior Publication Data

US 2018/0306455 A1 Oct. 25, 2018

(30) Foreign Application Priority Data

Oct. 15, 2015 (WO) ..... PCT/CN2015/091981
Nov. 19, 2015 (EP) ..... 15195292

(51) Int. Cl.
*F24F 3/16* (2006.01)
*F24F 11/30* (2018.01)
(Continued)

(52) U.S. Cl.
CPC ..... *F24F 3/1603* (2013.01); *F24F 11/30* (2018.01); *F24F 11/65* (2018.01); *F24F 2110/00* (2018.01);
(Continued)

(58) Field of Classification Search
CPC ..... F24F 3/1603; F24F 11/30; F24F 11/65; F24F 2110/00; F24F 2110/10; F24F 2110/20; F24F 2221/32
(Continued)

(56) References Cited

U.S. PATENT DOCUMENTS 2,679,202 A * 5/1954 Koff ..... F24F 3/1603 165/127
5,276,630 A * 1/1994 Baldwin ..... F24F 11/00 700/276

(Continued)

FOREIGN PATENT DOCUMENTS

KR 101031530 B1 3/2011
WO 20140207629 A1 12/2014

*Primary Examiner* — Steven B McAllister
*Assistant Examiner* — Allen R Schult

(57) ABSTRACT

An air treatment system (100) is provided that comprises an air purifier (110) arranged to treat a first parameter of ambient air; a controller (130) arranged to control operation of the air purifier (110); and a sensor (120) arranged to detect a value indicative of the first parameter, and to output sensor data indicative of the value to the controller. The controller (130) is arranged to determine whether the sensor (120) and the air purifier (110) are in a same air space by controlling the air purifier (110) to operate in a test mode and analyzing sensor data from the sensor (120) received during the test mode. If the sensor (120) and the air purifier (110) are determined to be in the same air space, the controller (130) is arranged to control the air purifier (110) to operate in a mode based on sensor data from the sensor (120).

13 Claims, 5 Drawing Sheets

(51) Int. Cl.

| | |
|---|---|
| ***F24F 11/65*** | (2018.01) |
| ***F24F 110/00*** | (2018.01) |
| ***F24F 110/20*** | (2018.01) |
| ***F24F 110/10*** | (2018.01) |

(52) U.S. Cl.
CPC ..... *F24F 2110/10* (2018.01); *F24F 2110/20* (2018.01); *F24F 2221/32* (2013.01)

(58) Field of Classification Search
USPC ..... 454/187
See application file for complete search history.

(56) References Cited

U.S. PATENT DOCUMENTS

| | | | |
|---|---|---|---|
| 5,602,758 | A | 2/1997 | Lincoln |
| 2006/0086112 | A1 | 4/2006 | Bloemer |
| 2014/0319232 | A1 | 10/2014 | Gourlay |
| 2015/0052975 | A1 | 2/2015 | Martin |

* cited by examiner

AIR TREATMENT SYSTEM

This application is the U.S. National Phase application under 35 U.S.C. § 371 of International Application No. PCT/EP2016/074822, filed on Oct. 15, 2016, which claims the benefit of International Application No. PCT/CN2015/091981 filed on Oct. 15, 2015 and International Application No. 15195292.6 filed on Nov. 19, 2015. These applications are hereby incorporated by reference herein.

FIELD OF THE INVENTION

The present invention relates to an air treatment system.

BACKGROUND OF THE INVENTION

Air treatment devices enable users to treat the air around them, for example the air in their homes. While air treatment devices can be provided with sensors that measure parameters relating to air quality, not all air treatment devices have such sensors. Furthermore, the sensing operation (i.e. what is sensed) by such sensors may be limited. For these reasons, consumers often purchase separate air sensors.

SUMMARY OF THE INVENTION

It is an object of the invention to provide an air treatment system which improves control of an air treatment device. The invention is defined by the independent claims. The dependent claims define advantageous embodiments.

According to an aspect of the present invention, there is provided an air treatment system, comprising: an air purifier arranged to filter a surrounding ambient air to treat a first parameter of said ambient air; a controller arranged to control operation of the air purifier; and a first sensor arranged to detect a value indicative of the first parameter, and to output sensor data indicative of the value to the controller; wherein the controller is arranged to determine whether the first sensor and the air purifier are co-located in a same ambient air space by controlling the air purifier to operate in a first mode and analyzing sensor data from the first sensor received during the first mode; wherein if the first sensor and the air purifier are determined to be colocated in the same ambient air space, the controller is arranged to control the air purifier to operate in a second mode based on sensor data from the first sensor.

Hence, in such embodiments, the controller can control the air purifier to operate based on sensor data from the first sensor if the first sensor and the air purifier are in the same ambient air space (e.g. in the same room). The realization of this invention can lead to a better user experience and smarter operation of air purifiers. A problem which would occur if the air purifier would not know whether the sensor is in the same air space as the air purifier is the following. The sensor might be in another room where a window is open. Hence, the air purifier may receive information that a parameter x (e.g. particle concentration) is above a threshold t, even long time after t has been reached. Hence, information about colocation of sensor and air purifier renders it possible to obtain a better control of the air purifier.

The first mode (e.g. a test mode) need not be a dedicated mode of operation of the air purifier, and may just be a prechosen operation mode of the air purifier. Furthermore, the second mode need not be a single mode, but may in some embodiments be a regime of operation that is based on the sensor data.

In some embodiments, the actual operation of the air purifier may be similar in the first mode and the second mode. For example, if the air purifier is a purifier with a fan, the fan speed may be the same in the first mode and the second mode, with (for example) the period of operation being varied in the second mode based on the sensor data.

The air purifier is arranged to filter a surrounding ambient air. The term 'filter' is intended to be interpreted broadly as implying any form of processing of the surrounding ambient air so as to remove one or more constituents, components or contents or of the air. These may be chemical or particulate contents or constituents of the air for example. They may additionally or alternatively be fluid constituents such as water. The air purifier may be a dehumidifier for instance, configured to remove water from a surrounding ambient air. In any of these examples, the air purifier may have an air inlet for receiving or drawing air to be processed or filtered from the surrounding ambient air, and an air outlet for emitting filtered or processed air back into the surrounding ambient air.

Embodiments of the invention allow determination of whether a sensor is in a same ambient air space as the air purifier. By 'same ambient air space' may be meant located substantially within the same body of air within which the air purifier is located and which the air purifier is filtering or processing. This may mean that the air purifier and sensor are in the same room for example. Additionally or alternatively, it may mean that the air purifier and sensor are positioned such that there exists a free flow of air between the two. By 'free flow of air' is meant a natural (for instance unaided) free flow of air which exists in the absence for instance of any air channeling or ducting apparatus. The air purifier and sensor may be located in the same open body of air for example. The two may be located in the same space and fluidly connected by an open body of air, without any dedicated structural means for providing said fluid connection.

In some embodiments, in the first mode, the controller is arranged to control the air purifier to operate in a predetermined way; wherein the controller is arranged to store data related to an expected change of the first parameter, the expected change being indicative of a change in the first parameter that would be expected to be detected by the first sensor when the air purifier is operated in the predetermined way with the first sensor in the same ambient air space as the air purifier; wherein the controller is arranged to determine whether the first sensor and the air purifier are co-located in the same ambient air space by determining whether the sensor data received during the first mode corresponds to the expected change of the first parameter.

The expected change could be a change in the first parameter compared to a starting value of the first parameter. In some embodiments, the controller is arranged to determine the starting value of the first parameter using data from the first sensor prior to determining whether the air purifier is in the same ambient air space as the first sensor.

Hence, in such embodiments, the controller can determine if the air purifier and the first sensor are in the same room by comparing expected sensor values (or expected first parameter changes) with received sensor values (or received first parameter changes).

In some embodiments, in the second mode the controller is arranged to control the air purifier to operate in a high power mode until sensor data from the first sensor indicates that the first parameter has passed a target value; wherein once the first parameter has passed a target value, the controller is arranged to control the air purifier to operate in a low power mode. In some embodiments, the target value is a change in the first parameter compared to a starting value of the first parameter.

In some embodiments, if the first sensor and the air purifier are determined not to be co-located in the same ambient air space, the controller is arranged to control the air purifier to operate in a third mode that is independent of sensor data from the first sensor. Hence, the air purifier is not controlled based on the sensor data if the first sensor is not in the same ambient air space as the air purifier. Furthermore, the third mode need not be a single mode, but may in some embodiments be a regime of operation that is not based on the sensor data.

In some embodiments, the controller is arranged to determine whether the first sensor and the air purifier are co-located in the same ambient air space when the controller is activated. Activation could involve turning the controller on, or launching a program or application.

In some embodiments, after the controller has determined whether the first sensor and the air purifier are co-located in the same ambient air space, the controller is arranged to wait a predetermined time before newly determining whether the first sensor and the air purifier are co-located in the same ambient air space.

In some embodiments, the first sensor and the air purifier are wirelessly connected to the controller.

In some embodiments, the first sensor and the air purifier are wirelessly connected to an access point, and the controller is connected to the access point via a network.

In some embodiments, the controller is arranged to store information regarding capabilities of the air purifier and the first sensor.

In accordance with one or more embodiments, the air purifier and/or the first sensor may be moveable relative to one another. One or both of the air purifier and the first sensor may be portable for example. The air purifier and/or the first sensor may be standalone devices for instance, each adapted to enable easy repositioning or movement either within the same airspace or between different air spaces, or different spaces or rooms. This allows for significant flexibility and adaptability in terms of the relative arrangements of the purifiers and sensors and in terms of the particular functioning provided by the air treatment system within a given space or set of spaces. Since the controller is configured to enable determination of whether a purifier and sensor within the same ambient airspace, this adaptability may be provided without compromising on the efficiency or efficacy of the air treatment provided by the system.

In accordance with some examples, the air purifier and first sensor may form part of a network of movable or portable connected devices. The devices may be adapted to enable ready redeployment or redistribution of the devices within or between different spaces or rooms (including for instance between or within different ambient air spaces). This may allow for provision of a highly adaptable and flexible air treatment system. The capacity to determine whether a purifier and sensor of the system are within the same airspace enables this flexibility to be achieved without the risk of damaging or undermining efficient control of each of the purifiers. Should a sensor and a purifier be moved apart from one another as part of the reconfiguration of the system, the system provides means for determining that such separation has occurred and changing the control regime of the respective purifier accordingly.

In some embodiments, the air treatment system further comprises a second sensor arranged to detect a value indicative of a second parameter, and to output sensor data indicative of the value to the controller; wherein the controller is arranged to determine whether the second sensor and the air purifier are co-located in a same ambient air space by controlling the air purifier to operate in a fourth mode (e.g. a second test mode) and analyzing sensor data from the sensor received during the fourth mode; wherein if the second sensor and the air purifier are determined to be co-located in the same ambient air space, the controller is arranged to control the air purifier to operate based on sensor data from the second sensor.

In some embodiments, the fourth mode is a same mode operated at a same time as the first mode.

In some embodiments, the air treatment system further comprises a second air purifier arranged to filter a surrounding ambient air to treat the first parameter of said ambient air; wherein the controller is arranged to determine whether the first sensor and the second air purifier are co-located in the same ambient air space by controlling the second air purifier to operate in a first mode and analyzing sensor data from the first sensor received during the first mode; wherein if the first sensor and the second air purifier are determined to be co-located in the same ambient air space, the controller is arranged to control the second air purifier to operate based on sensor data from the first sensor.

According to another aspect of the invention, there is provided a controller for an air treatment system that comprises an air purifier arranged to filter a surrounding ambient air to treat a first parameter of said ambient air and a first sensor arranged to detect a value indicative of the first parameter; the controller comprising: a communication mechanism arranged to receive sensor data from the first sensor indicative of the value of the first parameter, and to send control information to the air purifier; a control mechanism arranged to determine the control information, and to determine whether the first sensor and the air purifier are co-located in a same ambient air space; wherein the control mechanism is arranged to determine whether the first sensor and the air purifier are co-located in the same ambient air space by controlling the air purifier to operate in a first mode and analyzing sensor data from the first sensor received during the first mode; wherein if the first sensor and the air purifier are determined to be co-located in the same ambient air space, the control mechanism is arranged to control the air purifier to operate in a second mode based on sensor data from the first sensor.

The controller of embodiments of the invention may be a dedicated device or may be a program or application running on a general purpose device such as a computer, smart phone or other mobile device.

According to another aspect of the invention, there is provided a method of controlling an air treatment system that comprises an air purifier arranged to filter a surrounding ambient air to treat a first parameter of said ambient air, and a first sensor arranged to detect a value indicative of the first parameter, the method comprising: controlling the air purifier to operate in a first mode; receiving sensor data from the first sensor received during the first mode; determining that the first sensor and the air purifier are co-located in a same ambient air space by analyzing sensor data from the first sensor received during the first mode; if the first sensor and the air purifier are determined to be co-located in the same ambient air space, controlling the air purifier to operate in a second mode based on sensor data from the first sensor.

In some embodiments, if the first sensor and the air purifier are determined not to be co-located in the same ambient air space, the method comprises controlling the air purifier to operate in a third mode that is not based on sensor data from the first sensor.

According to another aspect of the invention, there is provided a computer readable medium carrying computer readable code for controlling a controller to carry out the above method.

Advantageous embodiments of the controller, method and medium of the invention are formed by the above-mentioned embodiments of the system according to the invention. These and other aspects of the invention will be apparent from and elucidated with reference to the embodiments described hereinafter.

BRIEF DESCRIPTION OF THE DRAWINGS

Embodiments of the invention will now be described, by way of example only, with reference to the accompanying drawings, in which.

DETAILED DESCRIPTION OF EMBODIMENTS

Figure 1:
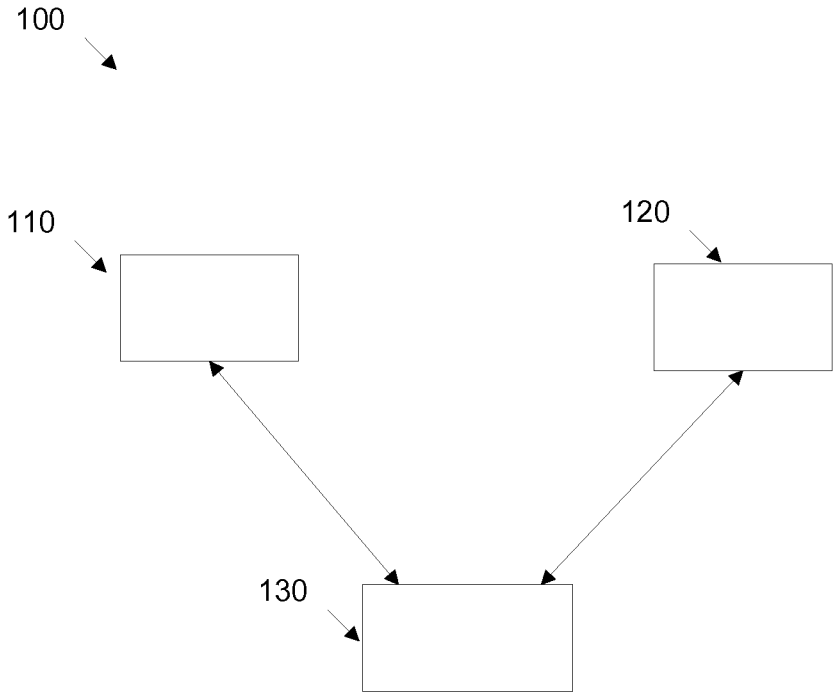
FIG. 1 schematically shows an air treatment system according to a first embodiment of the invention.

FIG. 1 schematically shows an air treatment system according to a first embodiment of the invention. The system 100 comprises an air purifier 110, a sensor 120, and a controller 130.

Figure 2A:
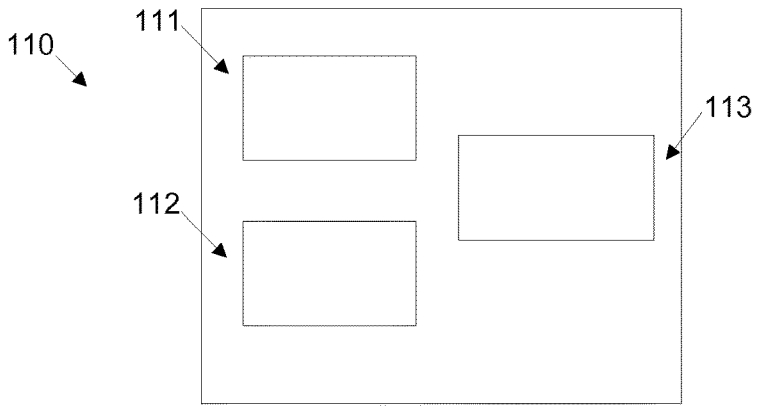
FIGS. 2*a*, 2*b* and 2*c* schematically show more detail regarding elements of the air treatment system according to the first embodiment of the invention.

The air purifier 110 is arranged to treat a first parameter of ambient air. In this embodiment, the air purifier 110 is an air purifier that is arranged to filter particulate matter from the air. In this embodiment, the air purifier 110 comprises a fan 111 and a filter 112 as shown in FIG. 2*a*. Hence, in this embodiment, the first parameter relates to a particle concentration. In this embodiment, the air purifier 110 also comprises a communications mechanism 113 for communication with the controller 130.

Figure 2B:
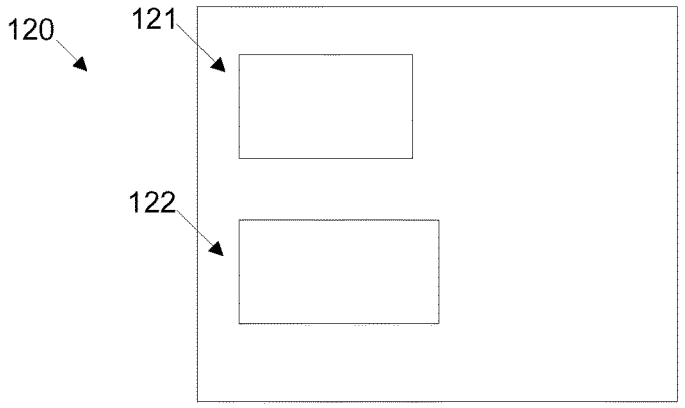

The sensor 120 is arranged to detect a value indicative of the first parameter. In this embodiment, the sensor 120 is a particle sensor that can determine the particle concentration in the air (e.g. using an optical sensing means). The sensor 120 is arranged to output sensor data indicative of the value to the controller 130. In this embodiment, the air sensor 120 comprises a particle sensor 121 and communications mechanism 122 for communication with the controller 130 as shown in FIG. 2*b*.

The controller 130 is arranged to control operation of the air purifier 110. As discussed below, the controller is 130 arranged to determine whether the sensor 120 and the air purifier 110 are in a same air space. If the sensor 120 and the air purifier 110 are determined to be in the same air space, the controller 130 is arranged to control the air purifier to operate in a mode based on sensor data from the sensor 120.

Figure 2C:
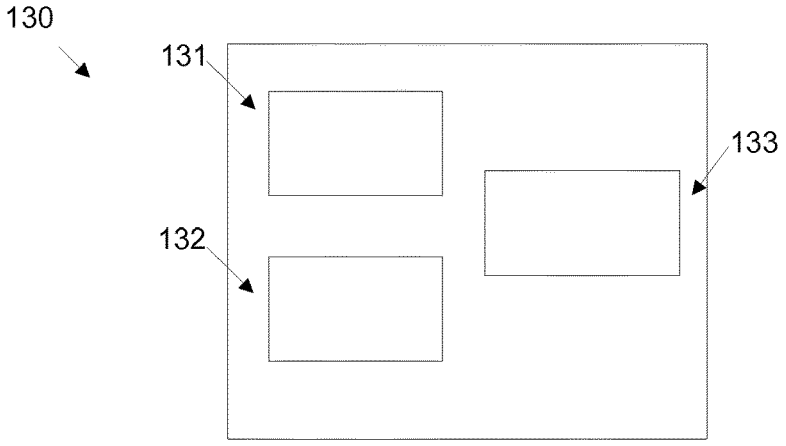

In this embodiment, the controller 130 comprises a control mechanism 131, a storage 132, and a communications mechanism 133 for communication with the sensor 120 and air purifier 110 as shown in FIG. 2*c*.

In this embodiment, the controller 130 stores information regarding the air purifier 110 and the sensor 120 in the storage 132. Specifically, the controller 130 stores information regarding the type of the air purifier 110 and the type of the sensor 120. For example, in this embodiment, the controller 130 stores that the air purifier 110 is an air purifier for filtering particulate matter from the air and that the sensor 120 is a particle sensor.

Figure 3:
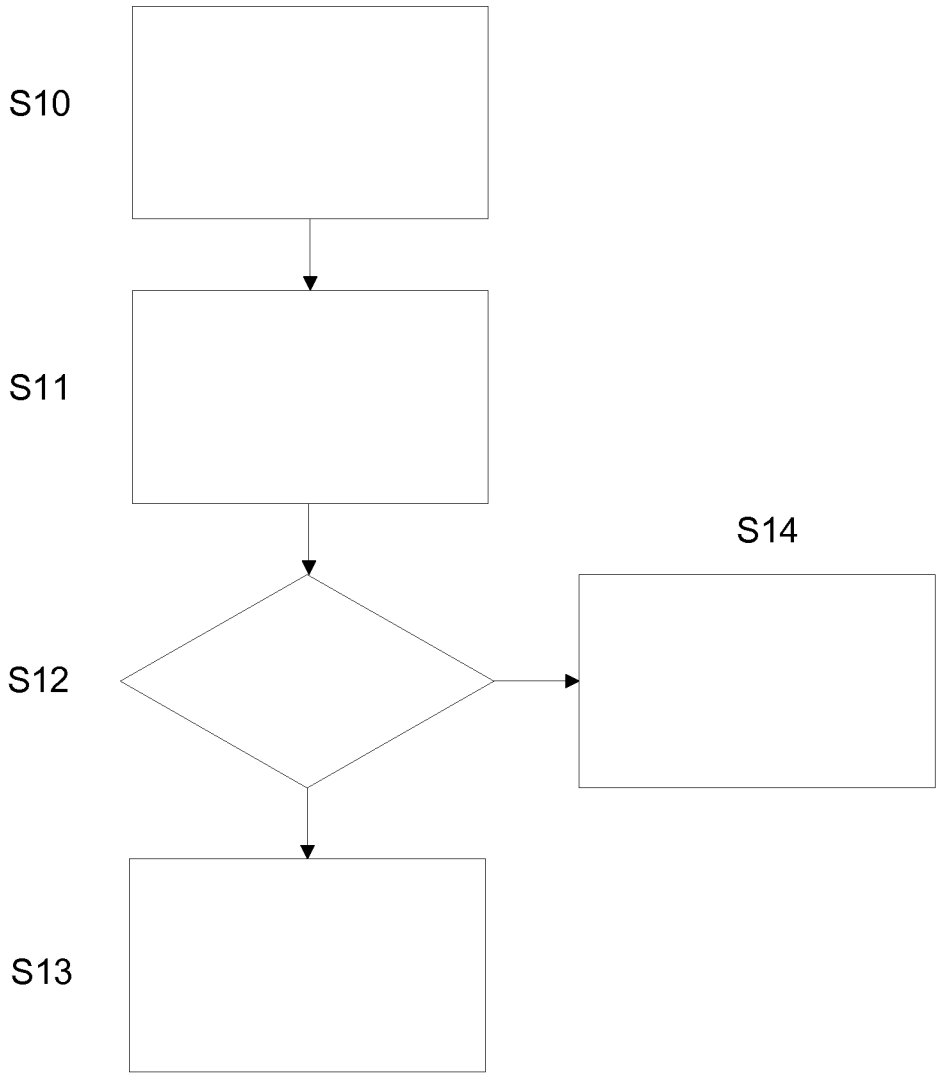
FIG. 3 shows a flow diagram explaining the operation of the system of the first embodiment.

The operation the first embodiment will be discussed in relation to FIG. 3.

At step S10 (control air purifier to operate in test mode), the controller 130 controls the air purifier 110 to operate in a first mode (e.g. a test mode). In this embodiment, the first mode relates to a predetermined operation of the fan of the air purifier 110. For example, purely as an illustrative example, the fan of the air purifier 110 may be operable at a low speed, medium speed and a high speed. The first mode may correspond to running the fan of the air purifier 110 for a predetermined time (e.g. 5 minutes).

At step S11 (receive sensor data from the sensor), the sensor 120 collects sensor data relating to the particle concentration and sends this data to the controller 130 using the communications mechanism 122.

At step S12 (in same air space?), the controller 130 determines whether the sensor 120 and the air purifier 110 are in a same air space (e.g. in the same room) by analyzing sensor data from the sensor 120 received during the first mode.

In this embodiment, the controller 130 is arranged to store data related to an expected change of the first parameter (particle concentration, in this example) during the first mode in the storage 132.

In this embodiment, the expected change is indicative of a change in the first parameter that would be expected when the air purifier 110 is operated in the first mode (medium fan speed, in this example) with the sensor 120 in the same air space as the air purifier 110. In other words, with the fan of the air purifier 110 operating at medium speed and with the sensor 120 in the same room as the air purifier 110, it would be expected that the sensor 120 would detect a fall in the particle concentration. Hence, the expected change in this embodiment could relate to a fall in particle concentration below a threshold. The threshold could be determined relative to the starting particle concentration. In other words, the threshold could relate to a drop relative to the starting particle concentration.

The control mechanism 131 of controller 130 is arranged to determine whether the sensor 120 and the air purifier 110 are in the same air space by determining whether the sensor data received during the first mode corresponds to the expected change of the first parameter. Hence, in this embodiment, the controller 130 compares the received sensor data during the first mode.

If the received sensor data corresponds to the expected change (e.g. the particle concentration has fallen below the threshold), then the controller 130 determines that the sensor 120 and the air purifier 110 are in the same air space. The controller 130 is then arranged (see S13—operate air purifier in a mode dependent on sensor data from the sensor) to control the air purifier 110 to operate in a mode that is dependent on sensor data from the sensor (e.g. a second mode). The controller 130 can achieve this by sending suitable control commands to the air purifier 110 via the control mechanism 131. The control commands may be determined by the control mechanism 131 using information stored in the storage 132.

If the received sensor data does not correspond to the expected change (e.g. if the particle concentration has not fallen below the threshold), then the controller 130 determines that the sensor 120 and the air purifier 110 are not in the same air space. The controller 130 is then arranged (see S14—operate air purifier in a mode that is not dependent on sensor data from the sensor) to control the air purifier to operate in a mode that is not dependent on sensor data from the sensor 120 (e.g. a third mode).

If it is determined that the sensor 120 and the air purifier 110 are not in the same air space, then the sensor data from the sensor 120 is not useful as data for controlling the air purifier 110. In such a case, the controller 130 may control the air purifier 110 to operate in medium speed mode, either all the time or turning the air purifier 110 at periodic intervals.

If it is determined that the sensor 120 and the air purifier 110 are in the same air space, the controller 130 can control the air purifier 110 using the sensor data from the sensor 120. For example, in such a case, the controller 130 may control the air purifier 110 to operate in high speed mode to reduce the particle concentration to below a threshold (e.g. a predetermined drop relative to a starting value) in a short amount of time. Then, once the threshold of particle concentration has been reached, the controller 130 may control the air purifier 110 to operate in low speed mode either all the time or turning the air purifier 110 at periodic intervals. The low speed mode may maintain the desired particle concentration.

Hence, as a result of the sensor data, if it is determined that the sensor 120 and the air purifier 110 are in the same air space the controller 130, the particle concentration can be reduced quickly and then be maintained by the low speed mode. This ensures a rapid (or relatively rapid) reduction in the particle concentration, followed by extended operation at a low speed mode (which is quieter and uses less energy). This ensures efficient operation of the air purifier 110. If it is determined that the sensor 120 and the air purifier 110 are not in the same air space, then the controller 130 does not rely on the sensor data from the sensor 120.

In this embodiment, the controller 130 is arranged to determine whether the sensor 120 and the air purifier 110 are in the same air space when the controller is activated. For example, this may be when the controller 130 is switched on.

In some embodiments, once the controller 130 has determined whether the sensor 120 and the air purifier 110 are in the same air space, the controller 130 waits a predetermined time before newly determining whether the sensor 120 and the air purifier 110 are in the air same space. By doing this, the controller 130 can periodically check to see if the sensor 120 has moved to or from the air space of the air purifier 110.

In this embodiment, the sensor 120 and the air purifier 110 are wirelessly connected to the controller 130. In other words, in this embodiment, the communications mechanisms of the sensor 120, the air purifier 110 and controller 130 all communicate wirelessly. However, in other embodiments, other connection methods may be used. For example, the controller 130 may be connected to the air purifier 110 and the sensor 120 via the internet or other suitable work.

Connected air purifiers allow remote control (e.g. through the Internet) of the purifier so that a user can activate the air purifier before arriving home). With such a connected environment, a controller 130 (e.g. which could be implemented as an application on a mobile telephone or on one of the devices or remotely on the Internet) can automatically or via user input control the connected devices to deliver the air quality as required. This control may be based on the sensor readings.

A problem arises because the air purifier 110 and sensor 120 are not fixed in position so that the system needs to know the relative positions, for example, whether the sensor 120 is in the same space as the particulate purifier. In this context, it is not just about the relative distance between the two devices but whether they are in the same space, meaning that air is freely exchanged between the two devices.

The information about colocation of sensor and air purifier is of particular importance for using sensor readings as basis to control the operation modes of the air purifier 110.

For instance, a system is turned on and runs in mode A treating the air until a parameter x (e.g. concentration of PM2.5) drops below a threshold t, which is the desired target value in this example. Now it is desired that this parameter should not change further but should be maintained (e.g. to avoid unnecessary power consumption). Therefore, mode B is activated (e.g. run at very low rate compared to mode A), just sufficient to compensate the counteracting force (e.g. particulate matter leakage from outside).

The problem which would occur if the air purifier 110 would not know whether the sensor 120 is in the same air space as the air purifiers is the following. The sensor 120 might be in another room where a window is open. Hence, in such a case the air purifier always receives the information that parameter x (e.g. particle concentration) is above threshold t, even long time after t has been reached. Hence, control of the air purifier 110 is improved with the information about colocation of sensor 120 and air purifier 110. As a result, embodiments of the invention can improve the performance of the air purifier by suitable control based on sensor data.

Embodiments of the invention can operate with more than one air purifier and more than one sensor. The sensor(s) can be used to measure the effect of the air purifier(s) (e.g. purifier, (de)humidifier) and thereby determine if the sensor(s) (standalone or integrated) are in the same air space as the air purifier(s).

The method may involve taking a sensors reading V1 from a target sensor device S1. In some embodiments, multiple readings can be taken to determine background changes or baseline drift. An air purifier is activated, and sensor readings (V2, V3, V4 etc.) are taken as the air purifier is running. Based on the changes in the sensor readings and the expected effort of the air purifier, it can be determined if the sensors and the air purifier are co-located in the same space or not.

The above steps may be part of a more comprehensive command and communication sequence controlled by the controller. This sequence may include steps required to automatically switch on and off the different system components and to induce correct operation modes.

A single air purifier can be activated each time to determine colocation or not. However, if the two air purifiers have independent functions (e.g. humidification, purifying) then the determination can be run in parallel for both. As an example, consider a sensor box with particulate matter (PM), temperature (T), and relative humidity (RH) sensors and a connected air purifier and humidifier. By activating the purifier and measuring the change in the PM sensor, the system can determine if the sensor box and purifier are in the same air space. This can be similarly done with the humidifier.

Detecting whether two devices are in the same air space need not be binary. For example, a purifier in a separate room but with the door open will affect the air in the connected room. This can also be detected by the time delay and reduced impact of the purifier.

Such methods can also be used to determine whether two purifiers are co-located. For example, consider a purifier targeting particles and volatile organic compounds (VOCs) in general with a particle sensor. A second purifier is optimized for formaldehyde but also has a particle filter. By activating the second purifier, the first purifier can determine whether they are co-located based on its particle sensor. By knowing whether the air sensing and control devices are in the same air space, the system can intelligently control the air according to the user's preference.

In embodiments of the invention, the system comprises a number of connected devices, they can be connected in a number of ways: peer-to-peer; each to a control application; each to a web server for control; or via another method. The connection may be over a wireless network (e.g. WiFi or 3/4G data network).

When a new device (sensor or air purifier) is connected to the controller, its properties will be shared with the controller. The properties are split into two classes: sensing—a list of sensors in the device, may include details of units, sensitivity, performance etc.; and control—methods to control the air (purification, (de)humidifying etc.) may include details of expected performance (e.g. filter type and target pollutants)

Based on this data, the controller can test the colocation of the new device based on defined properties. During normal usage, the controller can confirm that relative locations have not changed by confirming the sensor readings when a control device is started.

It will be appreciated that synchronizing the user of co-located devices can have a number of benefits. For example, adjusting humidity using a dehumidified before starting an air purifier since purifier performance is best at certain humidity.

As another example, controlling the order operation of two air purifiers may lead to benefits. For example, using a high performance particle purifier before starting a targeted formaldehyde purifier so it does not get contaminated with particles will lead to improved performance.

Hence, it is appreciated that there are many benefits of controlling air purifiers based on sensor data, and that these benefits are only fully apparent if it is first determined that the sensor(s) are in the same air space as the air purifier(s).

Embodiments of the invention are not limited to particular types of air purifiers or types of sensors.

Non limiting examples of suitable air purifiers include: particulate matter removers (e.g. using fans and filters); VOC removers (using activated carbon); formaldehyde removers; humidifiers; dehumidifiers; carbon dioxide removers; oxygen providers; ad ionization devices.

Non limiting examples of suitable sensors include: particle sensors (e.g. using optical sensors); aerosol sensors; VOC sensors; formaldehyde sensors; relative humidity sensors; temperature sensors; carbon dioxide sensors; oxygen sensors; and ionization sensors.

Figure 4:
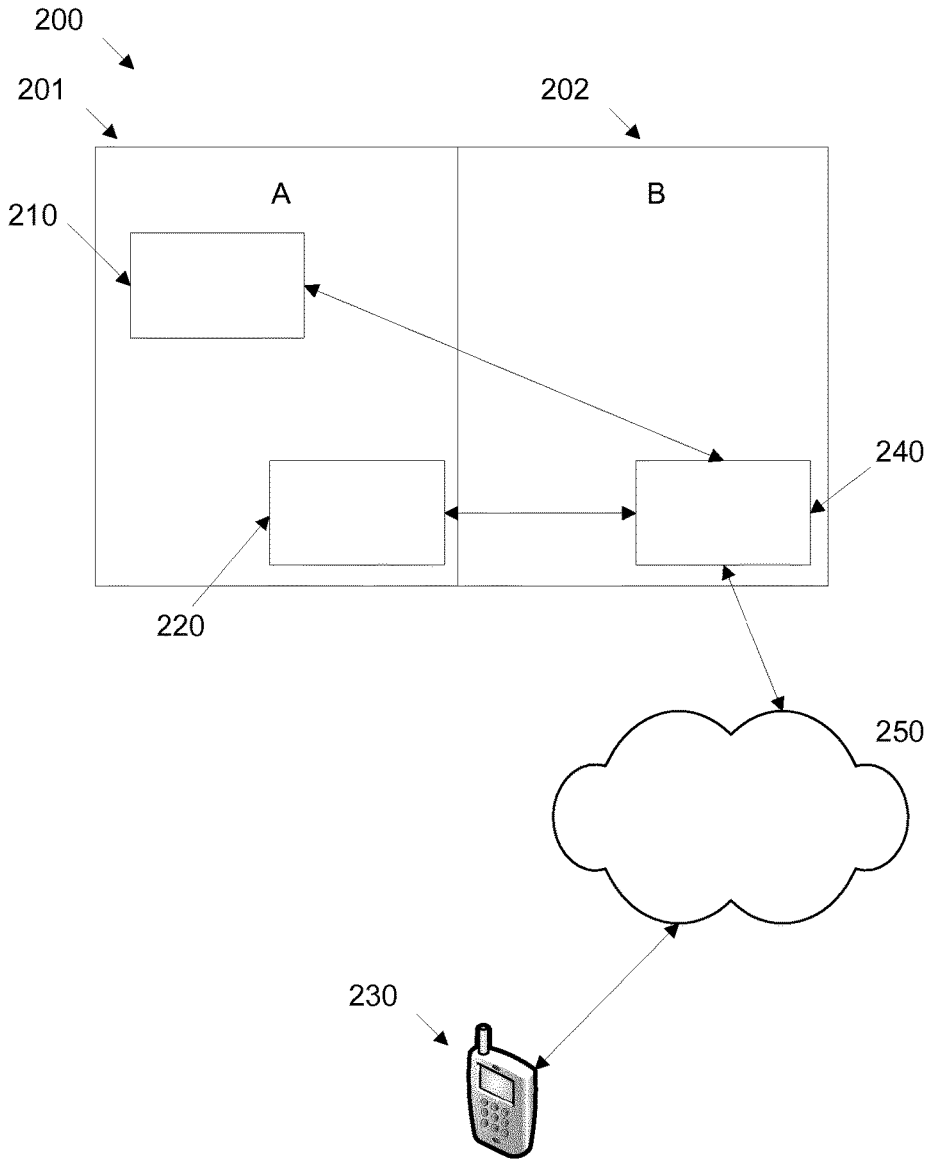
FIG. 4 shows an air treatment system according to a second embodiment of the invention.
Figure 5:
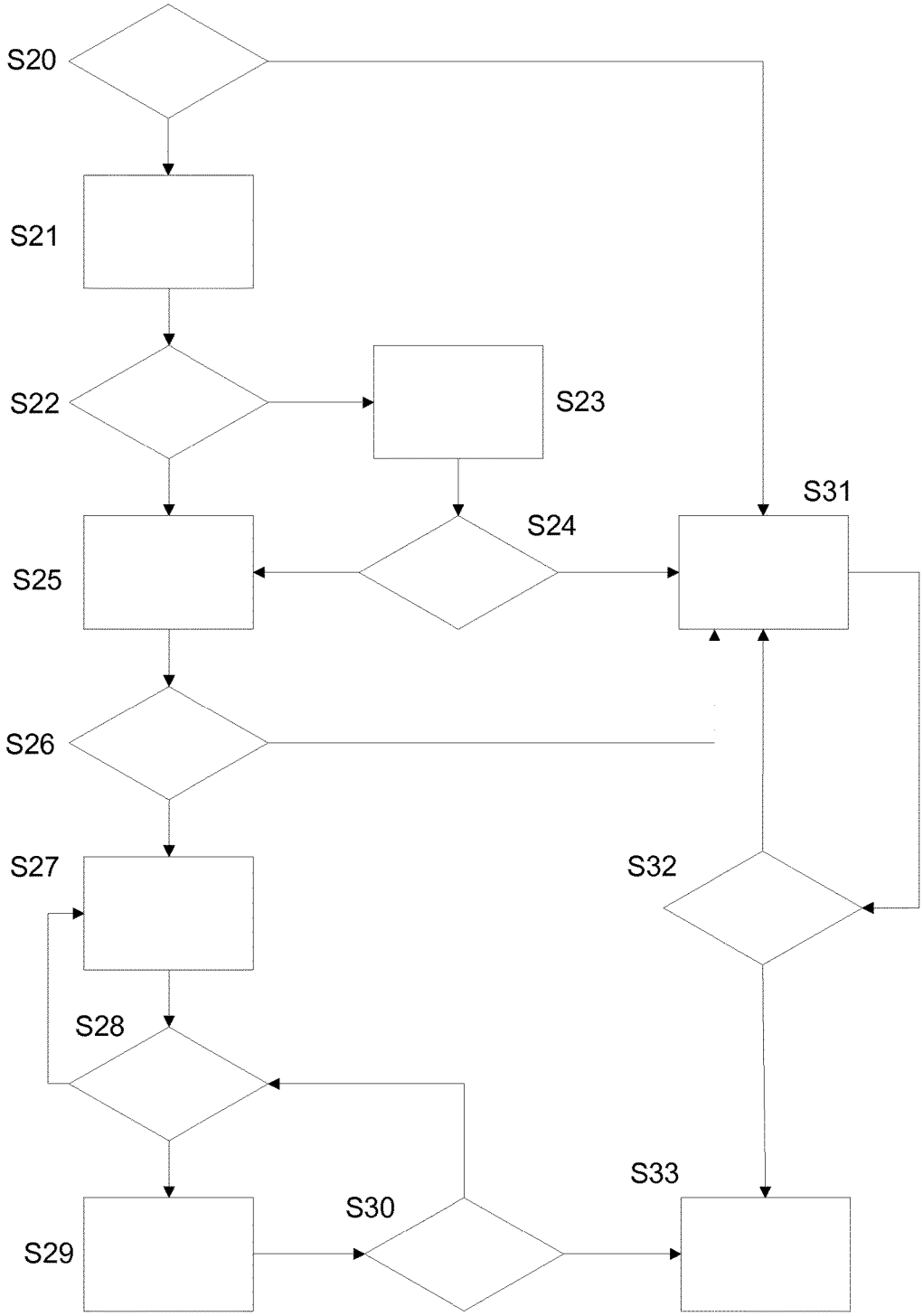
FIG. 5 shows a flow diagram explaining the operation of the system of the second embodiment.

FIG. 4 schematically shows an air treatment system 200 according to a second embodiment of the invention. The system 200 comprises an air purifier 210, a sensor 220, a controller 230, and an access point 240.

The purifier 210 is arranged to filter particulate matter from the air. In this embodiment, the purifier 210 comprises a fan (not shown) and a filter (not shown). In this example, the purifier 210 can operate in modes: turbo (very high fan speed purification mode); H (fan speed purification mode); M (medium fan speed purification mode); and L (low fan speed purification mode).

In this embodiment, the sensor 220 is a particle sensor that can determine the particle concentration in the air.

The purifier 210 and the sensor 220 are wireless connected to an access point (AP) 240 by Wifi. In this embodiment, both the sensor 220 is moveable between Room A 201 are Room B 202, which are rooms in the user's house or apartment. In this example, Room A 201 is the user's living room.

The controller 230 is arranged to control operation of the purifier 210. In this embodiment, the controller 230 is implemented using an application on a smartphone of the user. The controller 230 is connected to the AP 240 over the internet 250.

As discussed below, the controller is 230 arranged to determine whether the sensor and the purifier are in a same air space (i.e. both in Room A 201 or Room B 202 in this example). If the sensor 220 and the purifier 210 are determined to be in the same air space, the controller 230 is arranged to control the purifier 210 to operate in a mode based on sensor data from the sensor 220.

In the example embodiment, a user wants to clean the air inside his living room (Room A 201) in a fast way and then maintain particle concentration below a threshold t without wasting energy.

The user starts the process using the application on his smartphone to activate the controller 230. At step S20 (sensor registration data present?), the application checks its database to determine whether any sensors are registered in the application. In this example, an initial registration of system components such as sensors is required so that the system knows whether to induce the co-location assessment. During such a registration, sensor specific data may be uploaded into the controller's database (not shown). This information might include manufacturer, type of sensor, accuracy, IP-address etc.).

If no sensor is registered, the controller 230 knows that no sensors are available in the household and therefore an airspace co-location determination is meaningless. Instead, the controller 230 controls the purifier to execute mode M (medium fan speed purification mode in this example) at step S31 (run mode M) until a predetermined time has been reached (S32—predetermined time reached?) before stopping (S33).

If however, a sensor has been registered before, it is useful to determine whether sensor 220 and air purifier 210 are in the same air space (i.e. in the same room in this example), so that the former can be leveraged to optimize the operation of the later.

In order to do this, at step S21 (activate sensor and request baseline data V1) the controller 230 sends an activation command to the sensor 220 together with a request to provide the baseline concentration V1 at step S22 (V1 data received?). If this data is not received, then at step S23 (resend sensor activation command), the controller 230 resends the activation command. If this data is still not received (step S24—V1 data received?), the controller 230 controls the purifier to execute mode M (medium fan speed purification mode in this example) at step S31 until a predetermined time (e.g. 5 minutes) has been reached (S32).

Once baseline concentration V1 been received by the controller 230, the controller 230 activates mode B in the purifier 210 (step S25—start mode B and collect V2, V3, V4 . . . ). Mode B in this example is the turbo mode. As a result, the particle concentration around the purifier 210 will decrease relatively fast.

Therefore, the values provided by the sensor 220 should decrease relatively fast as long as sensor 220 and purifier 210 are in the same air space.

Correspondingly, at step S26 (V1>V2>V3>V4?), the control unit analyses whether values of the sensor data at successive units of time (e.g. at one minute intervals) V2, V3 and V4 satisfy V1>V2>V3>V4.

If V1>V2>V3>V4, then the controller 230 can infer that that both the sensor 220 and the purifier 210 are in the same air space and can initiate modes optimized for this scenario.

For example, in this embodiment, the controller 230 controls the purifier 210 to operate first in a fast-clean mode H (S27—Run mode H) until the concentration drops below a target level t (S28—V below threshold?) and then switches to a more energy efficient mode L with lower flow rate (S29—Run mode L) until a predetermined time has been reached (S30—predetermined time reached?) before stopping (S33). It will be appreciated that other embodiments could operate differently. For example, once concentration drops below the target level t, the controller 230 could control the purifier 210 to switch off, and then switch on again (e.g. at the energy efficient mode L with lower flow rate) in order to maintain concentration below the target level t. Alternatively, once concentration drops below the target level t, the controller 230 could control the purifier 210 to operate at the energy efficient mode L until a lower threshold is reached.

If V1>V2>V3>V4 is not satisfied, then the controller 230 can infer that that both the sensor 220 and the purifier 210 are not in the same air space and then controller 230 controls the purifier to execute mode M (medium fan speed purification mode in this example) at step S31 until a predetermined time has been reached (S32) before stopping (S33).

It will be appreciated that embodiments of the invention are not be limited to a decrease of a parameter. An increase of a parameter after activating the air purifier could also occur and be used to determine a co-location with the sensor. This could for instance be the case when using an air humidifier and a humidity sensor.

It will be appreciated that the hardware used by embodiments of the invention can take a number of different forms. For example, all the components of the controller could be provided by a single device (e.g. the example of FIG. 2*c*), or different components of the system could be provided on separate devices. More generally, it will be appreciated that embodiments of the invention can provide a system that comprises one device or several devices in communication.

It will be appreciated that the term "comprising" does not exclude other elements or steps and that the indefinite article "a" or "an" does not exclude a plurality. A single processor may fulfil the functions of several items recited in the claims. The mere fact that certain measures are recited in mutually different dependent claims does not indicate that a combination of these measures cannot be used to an advantage. Any reference signs in the claims should not be construed as limiting the scope of the claims.

Although claims have been formulated in this application to particular combinations of features, it should be understood that the scope of the disclosure of the present invention also includes any novel features or any novel combinations of features disclosed herein either explicitly or implicitly or any generalization thereof, whether or not it relates to the same invention as presently claimed in any claim and whether or not it mitigates any or all of the same technical problems as does the parent invention. The applicants hereby give notice that new claims may be formulated to such features and/or combinations of features during the prosecution of the present application or of any further application derived therefrom.

The invention claimed is:

1. An air treatment system comprising:

an air treatment unit arranged to treat a first parameter of ambient air;

a controller arranged to control operation of the air treatment unit; and a first sensor arranged to detect a value indicative of the first parameter, and to output sensor data indicative of the value to the controller;

wherein the controller is arranged to determine whether the first sensor and the air treatment unit are co-located in a same ambient air space by controlling the air treatment unit to operate in a first mode and analyzing sensor data from the first sensor received during the first mode;

wherein if the first sensor and the air treatment unit are determined to be co-located in the same ambient air space, the controller is arranged to control the air treatment unit to operate in a second mode based on sensor data from the first sensor, wherein the air treatment unit comprises an air purifier arranged to filter surrounding ambient air to treat the first parameter of the ambient air; and if the first sensor and the air purifier are determined not to be co-located in the same ambient air space, the controller is arranged to control the air purifier to operate in a third mode that is independent of sensor data indicative of the first parameter, and wherein after the controller has determined whether the first sensor and the air purifier are co-located in the same ambient air space, the controller is arranged to wait a predetermined time before newly determining whether the first sensor and the air purifier are in the air same space.

2. The air treatment system according to claim 1, wherein the first sensor and the air purifier are wirelessly connected to the controller; or the first sensor and the air purifier are wirelessly connected to an access point, and the controller is connected to the access point via a network.

3. The air treatment system according to claim 1, wherein in the first mode, the controller is arranged to control the air purifier to operate in a predetermined way;

wherein the controller is arranged to store data related to an expected change of the first parameter, the expected change being indicative of a change in the first parameter that would be expected to be detected by the first sensor when the air purifier is operated in the predetermined way with the first sensor in the same ambient air space as the air purifier;

wherein the controller is arranged to determine whether the first sensor and the air purifier are co-located in the same ambient air space by determining whether the sensor data received during the first mode corresponds to the expected change of the first parameter.

4. The air treatment system as claimed in claim 1, wherein the air purifier and/or the first sensor are moveable relative to one another.

5. The air treatment system according to claim 1, wherein in the second mode the controller is arranged to control the air purifier to operate in a high power mode until sensor data from the first sensor indicates that the first parameter has passed a target value;

wherein once the first parameter has passed the target value, the controller is arranged to control the air purifier to operate in a low power mode.

6. The air treatment system according to claim 5, wherein the target value is a change in the first parameter compared to a starting value of the first parameter.

7. The air treatment system according to claim 1, wherein the controller is arranged to determine whether the first sensor and the air purifier are co-located in the same ambient air space when the controller is activated.

8. An air treatment system comprising:

an air treatment unit arranged to treat a first parameter of ambient air;

a controller arranged to control operation of the air treatment unit; and a first sensor arranged to detect a value indicative of the first parameter, and to output sensor data indicative of the value to the controller;

wherein the controller is arranged to determine whether the first sensor and the air treatment unit are co-located in a same ambient air space by controlling the air treatment unit to operate in a first mode and analyzing sensor data from the first sensor received during the first mode;

wherein if the first sensor and the air treatment unit are determined to be co-located in the same ambient air space, the controller is arranged to control the air treatment unit to operate in a second mode based on sensor data from the first sensor, wherein the air treatment unit comprises an air purifier arranged to filter surrounding ambient air to treat the first parameter of the ambient air; and if the first sensor and the air purifier are determined not to be co-located in the same ambient air space, the controller is arranged to control the air purifier to operate in a third mode that is independent of sensor data indicative of the first parameter, and wherein the controller is arranged to store information regarding capabilities of the air purifier and the first sensor.

9. An air treatment system comprising:

an air treatment unit arranged to treat a first parameter of ambient air;

a controller arranged to control operation of the air treatment unit; and a first sensor arranged to detect a value indicative of the first parameter, and to output sensor data indicative of the value to the controller;

wherein the controller is arranged to determine whether the first sensor and the air treatment unit are co-located in a same ambient air space by controlling the air treatment unit to operate in a first mode and analyzing sensor data from the first sensor received during the first mode;

wherein if the first sensor and the air treatment unit are determined to be co-located in the same ambient air space, the controller is arranged to control the air treatment unit to operate in a second mode based on sensor data from the first sensor, and wherein the air treatment unit comprises an air purifier arranged to filter surrounding ambient air to treat the first parameter of the ambient air; and if the first sensor and the air purifier are determined not to be co-located in the same ambient air space, the controller is arranged to control the air purifier to operate in a third mode that is independent of sensor data indicative of the first parameter, further comprising:

a second sensor arranged to detect a value indicative of a second parameter, and to output sensor data indicative of the value to the controller;

wherein the controller is arranged to determine whether the second sensor and the air purifier are co-located in a same ambient air space by controlling the air purifier to operate in a fourth mode and analyzing sensor data from the second sensor received during the fourth mode;

wherein if the second sensor and the air purifier are determined to be co-located in the same ambient air space, the controller is arranged to control the air purifier to operate further based on sensor data from the second sensor.

10. An air treatment system comprising:

an air treatment unit arranged to treat a first parameter of ambient air;

a controller arranged to control operation of the air treatment unit; and a first sensor arranged to detect a value indicative of the first parameter, and to output sensor data indicative of the value to the controller;

wherein the controller is arranged to determine whether the first sensor and the air treatment unit are co-located in a same ambient air space by controlling the air treatment unit to operate in a first mode and analyzing sensor data from the first sensor received during the first mode;

wherein if the first sensor and the air treatment unit are determined to be co-located in the same ambient air space, the controller is arranged to control the air treatment unit to operate in a second mode based on sensor data from the first sensor, and wherein the air treatment unit comprises an air purifier arranged to filter surrounding ambient air to treat the first parameter of the ambient air; and if the first sensor and the air purifier are determined not to be co-located in the same ambient air space, the controller is arranged to control the air purifier to operate in a third mode that is independent of sensor data indicative of the first parameter, further comprising:

a second air purifier arranged to filter a surrounding ambient air to treat the first parameter of ambient air;

wherein the controller is arranged to determine whether the first sensor and the second air purifier are co-located in the same ambient air space by controlling the second air purifier to operate in a fifth mode and analyzing sensor data from the first sensor received during the fifth mode;

wherein if the first sensor and the second air purifier are determined to be co-located in the same ambient air space, the controller is arranged to control the second air purifier to operate based on sensor data from the first sensor.

11. A controller for an air treatment system that comprises an air treatment unit arranged to treat a first parameter of ambient air, and a first sensor arranged to detect a value indicative of the first parameter; the controller comprising:

a communication mechanism arranged to receive sensor data from the first sensor indicative of the value of the first parameter, and to send control information to the air treatment unit;

a control mechanism arranged to determine the control information, and to determine whether the first sensor and the air treatment unit are co-located in a same ambient air space;

wherein the control mechanism is arranged to determine whether the first sensor and the air treatment unit are co-located in the same ambient air space by controlling the air treatment unit to operate in a first mode and analyzing sensor data from the first sensor received during the first mode;

wherein if the first sensor and the air treatment unit are determined to be co-located in the same ambient air space, the control mechanism is arranged to control the air treatment unit to operate in a second mode based on sensor data from the first sensor, and wherein the air treatment unit comprises an air purifier arranged to filter surrounding ambient air to treat the first parameter of the ambient air; and if the first sensor and the air purifier are determined not to be co-located in the same ambient air space, the controller is arranged to control the air purifier to operate in a third mode that is independent of sensor data indicative of the first parameter, wherein the controller is arranged to store information regarding capabilities of the air purifier and the first sensor.

12. A method of controlling an air treatment system that comprises an air treatment unit arranged to treat a first parameter of ambient air, and a first sensor arranged to detect a value indicative of the first parameter, the method comprising:

storing, via a controller, information regarding capabilities of the air treatment unit and the first sensor;

controlling, via the controller, the air treatment unit to operate in a first mode;

receiving sensor data from the first sensor received during the first mode;

determining, via the controller, that the first sensor and the air treatment unit are co-located in a same ambient air space by analyzing sensor data from the first sensor received during the first mode;

if the first sensor and the air treatment unit are determined to be co-located in the same ambient air space, controlling the air treatment unit to operate in a second mode based on sensor data from the first sensor; and wherein the air treatment unit comprises an air purifier arranged to filter surrounding ambient air to treat the first parameter of the ambient air; and if the first sensor and the air purifier are determined not to be co-located in the same ambient air space, the method comprises the step of controlling the air purifier to operate in a third mode that is independent of sensor data indicative of the first parameter.

13. A non-transitory computer readable medium embodied with computer readable code for controlling a controller to carry out the method of claim 12.

* * * * *